US005471684A

United States Patent [19]

Casale

[11] Patent Number: 5,471,684

[45] Date of Patent: Dec. 5, 1995

[54] CONVERTIBLE SPORTS CAP WITH SLIDING BRIM

[75] Inventor: Rudy J. Casale, Brooklyn, N.Y.

[73] Assignee: Rally Cap, Inc., Hauppauge, N.Y.

[21] Appl. No.: 138,955

[22] Filed: Oct. 19, 1993

[51] Int. Cl.[6] ..... A42B 1/06

[52] U.S. Cl. ..... 2/195.1; 2/10; 24/587

[58] Field of Search ..... 2/10, 195.1, 209.11, 2/209.12, 909, 918, 12, 171, 175.1, 175.2, 209.13, 422, 424; 24/587

[56] References Cited

U.S. PATENT DOCUMENTS 1,232,992 7/1917 Stering ..... 2/10

5,099,524 3/1992 Linday ..... 2/10

*Primary Examiner*—Diana Biefeld

*Attorney, Agent, or Firm*—Lackenbach Siegel Marzullo Aronson & Greenspan

[57] ABSTRACT

A sports hat construction includes a head covering portion having a lower opening defining a periphery. A brim portion is provided detachably secured to the head covering portion. An elongate band or strip, in the form of a male connector, is attached to the lower periphery of the head covering portion, while a female mating connector is secured to the brim. The male and female connectors are configurated and dimensioned to detachably engage each other in slidable relationship so that the brim can be slidably moved along the longitudinal length of the periphery of the cap. Advantageously, the head covering portion is selectively removable to permit the brim to continue to serve as a sun visor when the head covering portion is removed.

18 Claims, 2 Drawing Sheets

CONVERTIBLE SPORTS CAP WITH SLIDING BRIM

BACKGROUND OF THE INVENTION

The invention generally relates to hats, and, more particularly, to a convertible sports cap with a sliding brim.

The present invention is primarily directed to a sports cap construction, of the type including a generally soft head covering portion and a brim. While hats of this type are worn by people of all ages in many different environments, they are frequently referred to as "baseball caps" because they typically bear the emblems of a baseball team or some other sports team. Many children may have a number of such hats, one for each of their favorite teams. Frequently, children at sports stadiums, and elsewhere are observed turning the brim of their hats to the side or to the back of their head. This is frequently done for the effect or the look, but also frequently because having the brim to one side or to the back is more comfortable. This is particularly true when the child sits in one spot in a stadium for an extended period of time while being exposed to a strong sun. Children will, under those circumstances, whether inadvertently or knowingly, rotate the cap to have the brim act as a sun blocking device. However, the relative turning of the hat to position the brim in different positions about the head must be effected by temporarily taking the cap off or rotating the hat while it frictionally engages the head. Unless the hat is somewhat oversized, however, rotating the hat while it is on the head may be impossible or, at best, uncomfortable.

Many visored caps have been proposed. For example, in U.S. Pat. No. 2,787,791, a visor cap is disclosed that serves as a cap made from a rigid material but which can be folded into a flat body for ease in packing, shipping or storing. The cap is of unitary construction and exhibits the same drawback when the brim is to be rotated to one side or the other.

In U.S. Pat. No. Des. 267,364, a visored hat is shown which is formed from an integral sheet of material, suitably cut so as to provide a receiving area for the head. The brim cannot, however, be rotated with this construction while the hat is being worn without possible damage to the resilient members or fingers that are deflected when the head is received within the hat.

A cap is disclosed in U.S. Pat. No. 2,005,361 intended to be worn under varying conditions while keeping the hair in place. At the same time, the cap is intended to provide protection to the eyes from the sun. The cap is made from two principal parts, including a first, triangular piece and a visor attached so that the triangular piece can cover the hair while the visor provides shade for the eyes. Two of the corners must be tied together in order to hold the hat firmly in place. For this reason, it is not practical to rotate the hat while on the head. This construction, therefore, has the same drawback as in the previously described caps or hats.

SUMMARY OF THE INVENTION

Accordingly, it is an object of the present invention to provide a sports hat construction which does not have the drawbacks inherent in prior art designs.

It is another object of the present invention to provide a sports hat which is simple in construction and economical to manufacture.

It is still another object of the present invention to provide a sports hat of the type suggested which permits the brim to be moved to any point about the periphery of the hat without removing the hat or rubbing it against the head of the wearer.

It is yet another object of the present invention to provide a sports hat as suggested in the previous objects which permits the head covering portion to be removed while the brim can continue to be worn to provide shade from the sun, thereby providing a convertible sports cap.

It is a further object of the present invention to provide a sports hat construction in accordance with the previous objects which allows a logo or emblem on the head covering portion of the head to always face in the same direction notwithstanding the fact that the brim may be moved to one side or the other about the periphery of the hat.

In order to achieve the above objects, as well as other objects which will become apparent to those skilled in the art, a sports hat construction in accordance with the present invention comprises a head covering portion having a lower opening defining a periphery. A brim portion is provided intended to be secured to the head covering portion. First means are provided extending along the length of at least a portion of said periphery for providing one of two engaging members. Second means is provided along at least a portion of a proximate portion of said brim for providing another of the two engaging members. Said first and second means are movable relative to each other, whereby said head covering portion is movable relative to said brim. Advantageously, said head covering portion is selectively removable to permit the brim to continue to serve as a sun visor.

BRIEF DESCRIPTION OF THE DRAWINGS

These and other objects of the invention, as well as many of the intended advantages thereof, will become more readily apparent when reference is made to the following description taken in conjunction with the accompanying drawings.

DESCRIPTION OF THE PREFERRED EMBODIMENTS

Figure 1:
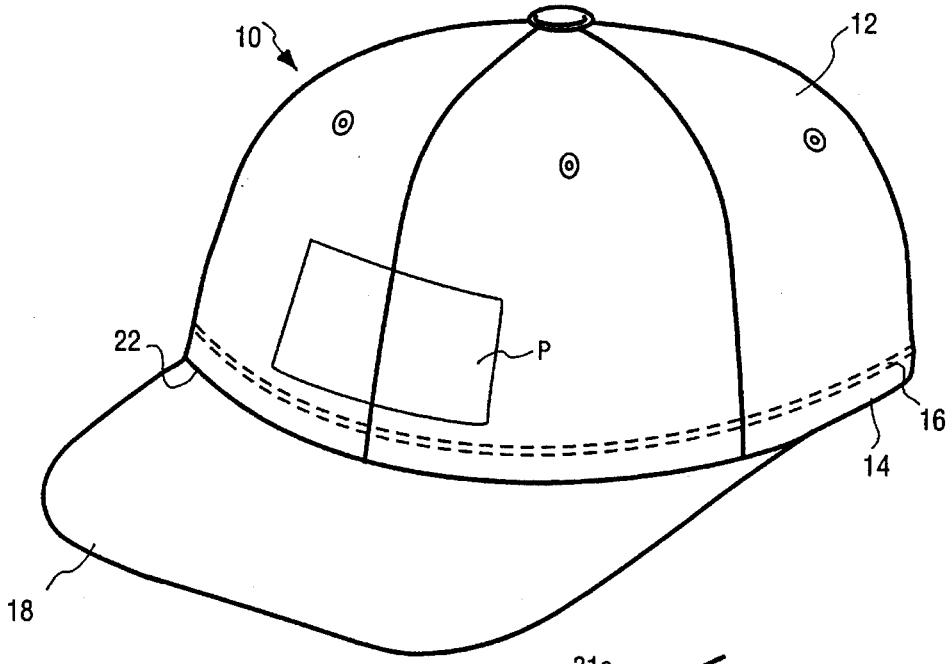
FIG. 1 is a perspective view of a convertible sports cap in accordance with the present invention, showing the brim positioned aligned with the front of the cap where a sports emblem or logo is attached.

Referring now specifically to the figures, in which identical or similar parts are designated by the same reference numerals throughout, and first referring to FIG. 1, there is illustrated a convertible sports cap in accordance with the present invention which is generally designated by the reference numeral 10. The cap 10 includes an upper head covering portion 12. A brim 18 has a proximate portion 22 shown secured to the head covering portion 12. Shown attached to the head covering portion 12 is a patch P typically embodying a logo or emblem of a sports team, a company, club or the like. The individual panels forming the head covering portion may be conventional, and those panels on which the patch P is attached to can generally be regarded as defining the front of the cap since most of the times such patches face the direction to the front of the wearer.

Figure 1A:
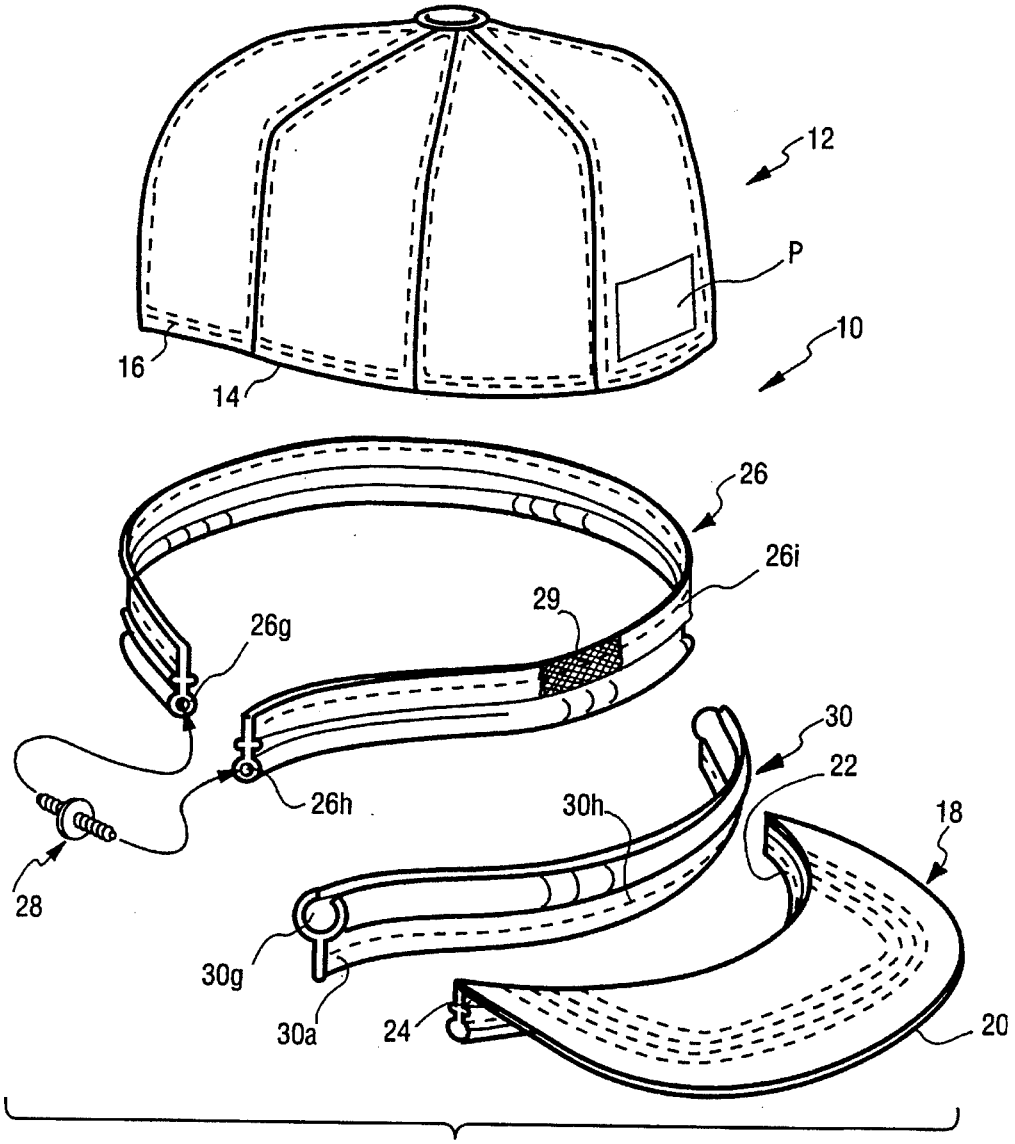
FIG. 1A is an exploded view of the sports cap shown in FIG. 1.

Referring to FIG. 1A, the cap 10 is shown in an exploded view to illustrate the component parts thereof that allow the present invention to be practiced. The head covering portion 12 is shown to include a lower edge 14 that defines a lower periphery extending along the lower stitching 16.

First means, in the form of an upper male elongate member 26 is provided which extends about at least a portion of the periphery 14 for providing one of two engaging slidable members. In the embodiment being described, the member 26 extends about the entire periphery 14. Second means, in the form of a lower female elongate strip 30, is provided along at least a portion of a proximate portion 22 of the brim 18 for providing another one of two engaging slidable members. As will be described below, the slidable members 26 and 30 are slidably movable relative to each other when engaged or interlocked.

Figure 2:
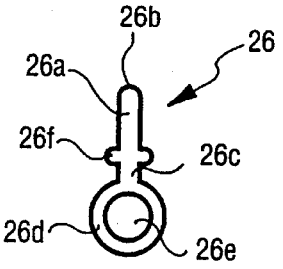
FIG. 2 is an end elevational view of the upper elongate element shown in FIG. 1A.
Figure 3:
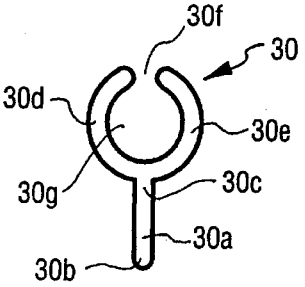
FIG. 3 is an end elevational view of the lower elongate element shown in FIG. 1A.

Also referring to FIG. 2, the upper male strip 26 includes a flat upper attaching portion 26*a* having an upper edge 26*b* and a lower edge 26*c*. Between the upper and lower edges 26*b*, 26*c*, is a protuberance 26*f* projecting laterally which serves as a stop or positioning guide for positioning the head covering portion lower edge 14 when being attached thereto. Attached to the lower edge 26*c* is a closed deformable resilient cylindrical member 26*d* which defines an internal space 26*e*. The lower elongate female strip 30 has a complementary construction to the upper male strip 26. Also referring to FIG. 3, it will be noted that the female strip 30 includes a generally flat lower attaching portion 30*a* having a lower free edge 30*b* and an upper edge 30*c* attached to opposing semi-cylindrical half portions 30*d*, 30*e* which are separated at the end opposite the free end 30*b* to form an elongate slot 30*f*. The female strip 30 defines an internal space 30*g* having internal dimensions substantially equal to the external dimensions of the closed resilient cylindrical member 26*d*. For reasons that will be evident, only one of the cylindrical member 26*d* and the semi-cylindrical half portions 30*d*, 30*e* need be resilient or deformable, although in the embodiment being described they are all resilient or deformable.

The sliding strips or bands 26 and 30 can be made out of any suitable material, including a plastic material that has a very smooth surface. In this manner, the closed resilient cylindrical member 26*d* can be forced into the internal space 30*g* by deformation of the cylindrical member 26*d* and/or the semi-cylindrical halves 30*d*, 30*e*. By avoiding a tight or press fit relationship when the male member is received within the female member, it will be appreciated that the female member can slide about the longitudinal length of the male member. For example, the outside diameter of the closed resilient cylindrical member 26*d* may be selected to be 0.20 inches while the inside diameter of the half portions 30*d*, 30*e* may be selected to be 0.23 inches. However, because of the resilience of these members, even abutment or internal contact of these members in their engaged conditions could still provide a sliding relationship, although some friction may have to be overcome. On the other hand, the clearance between these members, when engaged, cannot be excessive because control would be lost over the movements of the brim which could inadvertently slide along the upper male band or strip 26. Therefore, a close fit that provides some contact and friction is preferable. However, by ensuring that the internal surface of the cylinder member 26*d* and the external surface of the semi-cylindrical sections 30*d*, 30*e* are smooth, with the appropriate relative dimensions, the two members can slide easily relative to each other without binding. For example, the strips or bands 26, 30 can be extruded plyethylene. The closed loop length of the band 26 may be, for example, 7.5 inches long while the length of the band 30 can be up to the length of the band 26 or up to 7.5 inches, although it may be shorter.

Figure 4:
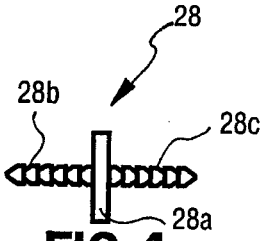
FIG. 4 is a side elevational view of a double-ended one-way fastener shown in FIG. 1A.

The length of the upper male band or strip 26 has a length equal to the peripheral length of the lower edge 14 of the head covering portion 12. In order to form the strip or band 26 into a closed loop, there is provided a double-ended fastener 28, the details of which are best shown in FIG. 4. As will be noted, the fastener 28 includes a generally flat thin stop 28*a*. Extending from the opposing sides of the stop 28*a* are fastener ends 28*b* and 28*c* as shown, each being barbed to facilitate insertion of each of the ends into an associated opening of the internal space 26*e* in pressure or friction relationship while preventing the ends from being easily removed. Once the fastener 28 is inserted into the strip or band 26, therefore, a closed loop is formed that does not easily open.

The male strip or band 26 is attached to the lower edge 14 of the head covering portion 12 by sewing the same along the stitching 16 and 26*i* so that the band or strip 26 becomes permanently fixed or attached to the head covering portion 12. It may be possible, however, to apply appropriate Velcro hook and loop fastener 29 surfaces so that the band or strip 26 can be semi-permanently attached to the head covering portion 12. Similarly, the female band or strip 30 is fixed to the brim 18 along the stitching lines 30*h* and 24, although a Velcro fastener may also be used in this instance.

It will be appreciated that when the band or strip 26 is attached to the head covering portion 12, and the brim 18 is attached to the female band or strip 30, the brim can easily be attached to or separated from the head covering portion 12 by means of the strips 26, 30.

When the strips 26, 30 are permanently or semi-permanently attached to the head covering portion 12 and the brim 18, respectively, the brim can be moved about the periphery 14 of the head covering portion 12 by longitudinally sliding the bands 26, 30 relative to each other. Also, when the head covering portion 12 is detachably connected to the band or strip 26, such as with Velcro hook and loop fastener, it also becomes possible to remove the head covering portion 12 by separating the same from the flat strip or portion 26*a* onto which the Velcro hook and loop fastener is secured. Similarly, if Velcro hook and loop fastener is used to retain the brim 20 on the lower female strip or band 30, the brim can likewise be detachably removed while the head covering portion 12 remains on the user's head.

Figure 6:
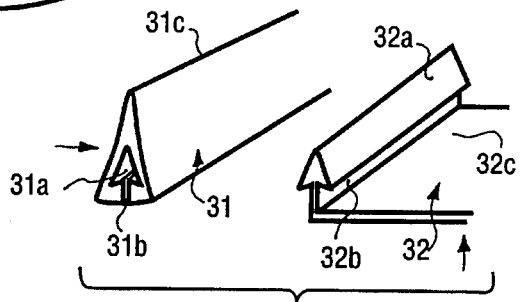
FIG. 6 is a perspective view illustrating the details of the interconnecting system shown in FIG. 5.
Figure 5:
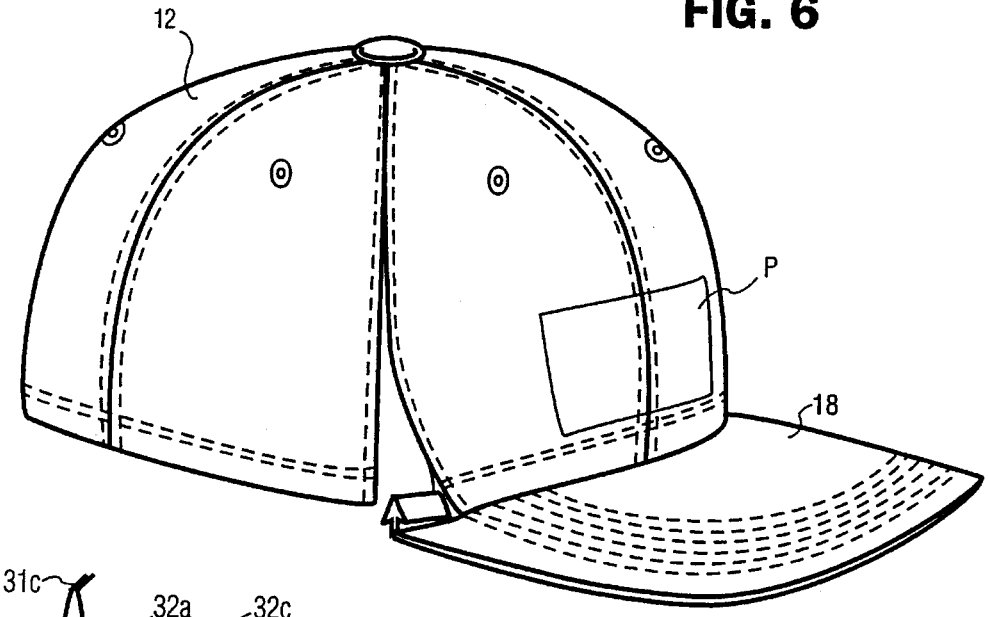
FIG. 5 is a perspective view of a cap similar to the one in FIG. 1, but showing a modified connecting system for slidably mounting the brim on the head covering portion.
Figure 6A:
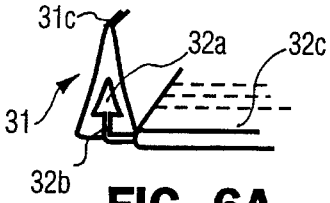
FIG. 6A is an end view of the system of components shown in FIG. 6 when engaged with one another.

Referring to FIGS. 6 and 6A, a further embodiment of the invention is illustrated in which the brim is slidably attached to the head covering portion 12 by means of an elongate female connector 31 which has, in cross-section, a triangular shaped channel 31*a* and longitudinal slot 31*b* as shown. The male connector 32 includes an elongate member 32*a* having a triangular cross-section which substantially corresponds to the cross-section of the opening 31*a*. The member 32*a* is supported on an elongate strip portion 32*b* which is, in turn, connected to or integrally formed with an attachment tab 32*c*. As suggested in FIG. 5, the tab 32*c* can be attached to the brim 18 in any suitable manner, such as by sewing or stitching. The female member 31 forms part of the head covering portion 12, the latter being connected to the member 31 in any suitable conventional manner at 31*c*. With this arrangement, it is clear that the male member 32*a*, in the form of a barbed member, can be forced into the space or cavity 31*a* by press fitting through the longitudinal slot 31*b*. Once the barbed triangular member 32*a* is received within the triangular opening 31*a*, the internal dimensions of the cavity 31*a* and the external dimensions of the member 32*a* are selected to provide for relative sliding movement therebetween. Once such engagement takes place, this construction does not encourage or facilitate the separation of the brim 18 from the head covering portion 12 but only provides relative sliding movement therebetween. It is clear, therefore, that numerous connectors or fasteners can be used to achieve the ends of the present invention, including permitting the removal of the head covering portion 12 to provide a sun visor. Also, the brim can be moved from side to side or to the back with or without the head covering portion in place.

Figure 3A:
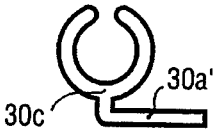
FIG. 3A is similar to FIG. 3 but showing a variant of the strip or band illustrated in FIG. 3.

Having described the invention, many modifications thereto will become apparent to those skilled in the art to which it pertains without deviation from the spirit of the invention as defined by the scope of the appended claims. For example, the cylindrical member 26*d* and the semi-cylindrical halves 30*d*, 30*e* can be interchanged so that the upper strip or band 26 becomes the female connector and the lower strip or band 30 becomes the male connector. Also, instead of a double-ended fastener 28, the ends of the band or strip 26 can be fused together in any manner, heat or adhesive, suitable for the material used for the band or strip. Also, referring to FIG. 3A, the lower attaching portion 30*a*' may be offset relative to the corresponding element in FIG. 3 to facilitate sewing or other attachment to the generally horizontally oriented brim.

What is claimed is:

1. A sports hat construction comprising a head covering portion having a lower opening defining a periphery; a brim having a proximate portion intended to be secured to said head covering portion; a first elongate means extending along said periphery for providing one of two relatively slidable members; a second elongate means provided along substantially the entire of said proximate portion for providing another of said two relatively slidable members, said first and second elongate means being engaged and slidably movable relative to each other along the longitudinal lengths thereof, said first elongate means having a length greater than the length of said second elongate means whereby said brim is movable on said first elongate means about said periphery relative to said head covering portion to different relative positions while said second elongate means is always fully engaged along its entire length with said first elongate means, one of said first and second elongate means receiving the other of said first and second elongate means and having a longitudinal slot along the length thereof, said first and second elongate means including retaining surfaces proximate to said longitudinal slot which are substantially normal to a radial direction in relation to the longitudinal length direction of said elongate means and extending through said longitudinal slot to resist separation of said elongate means from each other.

2. A sports hat construction as defined in claim 1, wherein said head covering portion is detachably connected to said first means.

3. A sports hat construction as defined in claim 1, wherein said head covering portion is secured to said first means by a hook and loop fastener.

4. A sports hat construction as defined in claim 1, wherein said head covering portion is permanently connected to said first means.

5. A sports hat construction as defined in claim 4, wherein said head covering portion is sewn to said first means.

6. A sports hat construction as defined in claim 1, wherein said first elongated means extends substantially about the entire length of the periphery of said head covering portion.

7. A sports hat construction as defined in claim 1, wherein said second elongated means extends along said entire proximate portion of said brim.

8. A sports hat construction as defined in claim 1, wherein said first elongated means comprises an elongate first mating member, and said second elongated means comprises an elongate second mating member.

9. A sports hat construction as defined in claim 8, wherein said first mating member comprises an elongate male connector, and said second mating member comprises an elongate female connector.

10. A sports hat construction as defined in claim 9, wherein said elongate male connector comprises an upper flat attachment strip having a free upper edge and an opposing lower edge, and an elongate closed cylindrical member joined to said lower edge of said upper flat attachment strip, and said elongate female connector comprises a lower flat attachment strip having a free lower edge and an opposing upper edge, and an elongate split cylindrical member formed of a pair of substantially semi-cylindrical members joined to said opposing upper edge of said lower flat attachment strip and defining a cylindrical internal space and slot, at least one of said closed cylindrical members and said split cylindrical member being resilient whereby said closed cylindrical member can be resiliently forced through said slot to be received into said cylindrical space.

11. A sports hat construction as defined in claim 10, wherein said upper flat attachment strip is attached to said periphery of said head covering portion.

12. A sports hat construction as defined in claim 10, wherein said lower flat attachment strip is attached to said proximate portion of said brim.

13. A sports hat construction as defined in claim 10, wherein said elongate male connector has a length substantially equal to the periphery of said head covering portion.

14. A sports hat construction as defined in claim 13, wherein said elongate male connector is formed into a closed loop having two free ends in juxtaposed position and further comprising a connecting means for joining said two free ends to each other.

15. A sports hat construction as defined in claim 14, wherein said connecting means comprises an in-line fastener having opposing portions frictionally receivable within opposing open ends of said closed cylindrical member.

16. A sports hat construction as defined in claim 9, wherein said elongate male connector comprises an elongate band having a barbed edge and said female connector comprises an elongate band having an elongate channel formed by wall surfaces having an elongate slot therein to provide said barbed edge access to said cavity in only one direction to thereby allow said male connector to be introduced into said female connector, said cavity and barbed edge having substantially similar cross-sections to permit relative sliding movements in the longitudinal directions of said bands.

17. A sports hat construction as defined in claim 8, wherein said mating members are detachably connectable from each other.

18. A sports hat construction as defined in claim 8, wherein said mating members are slidably connected to each other, whereby said brim can be slidably moved about said periphery of said head covering portion.

* * * * *